US005886275A

United States Patent [19]

Kato et al.

[11] Patent Number: 5,886,275

[45] Date of Patent: Mar. 23, 1999

[54] TRANSPORTING METHOD OF KARAOKE DATA BY PACKETS

[75] Inventors: Hirokazu Kato; Takuro Sone, both of Hamamatsu, Japan

[73] Assignee: Yamaha Corporation, Hamamatsu, Japan

[21] Appl. No.: 61,587

[22] Filed: Apr. 16, 1998

[30] Foreign Application Priority Data

Apr. 18, 1997 [JP] Japan ..... 9-102179

[51] Int. Cl.[6] ..... A63H 5/00; G04B 13/00; G10H 7/00

[52] U.S. Cl. ..... 84/609; 434/307 A

[58] Field of Search ..... 84/609, 610; 434/307 A

[56] References Cited

U.S. PATENT DOCUMENTS

| | | | |
|---|---|---|---|
| 5,357,505 | 10/1994 | Tsumura et al. . | |
| 5,588,842 | 12/1996 | Nishimura et al. | 434/307 A |
| 5,652,400 | 7/1997 | Fujimori et al. | 84/600 |
| 5,663,515 | 9/1997 | Kato | 84/609 |
| 5,689,081 | 11/1997 | Tsurumi | 84/609 |
| 5,691,494 | 11/1997 | Sai et al. | 84/609 |
| 5,725,383 | 3/1998 | Funahashi et al. | 434/307 A |
| 5,768,396 | 6/1998 | Sone | 434/307 A X |

*Primary Examiner*—William M. Shoop, Jr.
*Assistant Examiner*—Jeffrey W. Donels
*Attorney, Agent, or Firm*—Pillsbury Madison & Sutro LLP

[57] ABSTRACT

A method is designed for feeding karaoke data representative of karaoke performance to a karaoke apparatus having an audio section and a video section. The method is conducted by the following steps. The initial step is formatting the karaoke data containing various kinds of data items including music control data and word control data into a plurality of packets such that each packet is formed of a body containing a segment of the karaoke data and a header containing identification information indicating the kind of the karaoke data contained in the body of each packet. The next step is delivering the plurality of the packets in a stream to the karaoke apparatus according to a predetermined order by which the karaoke apparatus time-sequentially processes the stream of the packets. The further step is selectively distributing the music control data contained in the processed packets to the audio section in accordance with the identification information to thereby enable the audio section to generate music tones of the karaoke performance. The last step is selectively distributing the word control data contained in the processed packets to the video section in accordance with the identification information to thereby enable the video section to display lyric words of the karaoke performance in synchronization with the music tones.

15 Claims, 7 Drawing Sheets

TRANSPORTING METHOD OF KARAOKE DATA BY PACKETS

BACKGROUND OF THE INVENTION

1. Field of the Invention

The present invention generally relates to a method of transporting karaoke data, a karaoke apparatus, and a medium for recording karaoke data.

2. Description of Related Art

A karaoke system of communication type is called a communication karaoke in which karaoke data is distributed through a communication line to a karaoke terminal having a sound source for karaoke performance. In such a communication karaoke system, karaoke data including music control data, word control data, and picture data is handled as one or more files. The distributed karaoke data is temporarily stored in a recording medium such as a hard disk. When a karaoke song is specified, the karaoke data corresponding to the specified song is all loaded into a memory before karaoke performance of the song starts.

However, in the above-mentioned conventional method, the song data handled as a file is loaded into the memory before the karaoke performance starts. It takes much time in loading one set of song data files into the memory and expanding the loaded data into a format ready for the karaoke performance. At the same time, the conventional method requires a large capacity of the memory for loading the song data files.

SUMMARY OF THE INVENTION

It is therefore an object of the present invention to provide a method of transporting karaoke data, a karaoke apparatus, and a medium for recording karaoke data for reducing a standby time from requesting a song to starting karaoke performance and for reducing a memory capacity used for buffering karaoke data to be supplied and reproduced.

The inventive method is designed for feeding karaoke data representative of karaoke performance to a karaoke apparatus having an audio section and a video section. The inventive method comprises the steps of formatting the karaoke data containing various kinds of data items including music control data and word control data into a plurality of packets such that each packet is formed of a body containing a segment of the karaoke data and a header containing identification information indicating the kind of the karaoke data contained in the body of each packet, delivering the plurality of the packets in a stream to the karaoke apparatus according to a predetermined order by which the karaoke apparatus time-sequentially processes the stream of the packets, selectively distributing the music control data contained in the processed packets to the audio section in accordance with the identification information to thereby enable the audio section to generate music tones of the karaoke performance, and selectively distributing the word control data contained in the processed packets to the video section in accordance with the identification information to thereby enable the video section to display lyric words of the karaoke performance in synchronization with the music tones. Preferably, the step of formatting includes formatting picture data contained in the karaoke data into packets for delivery to the karaoke apparatus so that the picture data is distributed to the video section to display a background picture of the karaoke performance in superposed relation to the lyric words.

The inventive karaoke apparatus is operable according to karaoke data to provide karaoke performance. In the inventive karaoke apparatus, receiver means is provided for receiving a plurality of packets delivered in a stream according to a predetermined order by which the packets should be processed time-sequentially. Each packet is formed of a body containing a segment of the karaoke data and a header containing identification information indicating a kind of the karaoke data contained in the body of each packet. The karaoke data contains various kinds of data items including music control data and word control data. Distributor means is provided for time-sequentially processing the received packets to distribute the music control data and the word control data contained in the processed packets separately from one another according to the identification information contained also in the processed packets. Audio means is operative in response to the music control data selectively distributed thereto for generating music tones of the karaoke performance. Video means is operative in response to the word control data selectively distributed thereto for displaying lyric words of the karaoke performance in synchronization with the music tones. Preferably, the receiver means receives packets containing picture data as a part of the karaoke data, and the distributor means distributes the picture data contained in the received packets to the video means so as to display a background picture of the karaoke performance in superposed relation to the lyric words.

The inventive memory medium memorizes karaoke data representative of karaoke performance and is useable for feeding the karaoke data to a karaoke apparatus having an audio section and a video section. The memory medium records the karaoke data by formatting the karaoke data containing various kinds of data items including music control data and word control data into a plurality of packets such that each packet is formed of a body containing a segment of the karaoke data and a header containing identification information indicating the kind of the karaoke data contained in the body of each packet. The plurality of the packets are arranged for delivery in a stream to the karaoke apparatus according to a predetermined order by which the karaoke apparatus time-sequentially processes the stream of the packets, so that the music control data contained in the processed packets can be distributed to the audio section in accordance with the identification information to thereby enable the audio section to generate music tones of the karaoke performance, and so that the word control data contained in the processed packets can be distributed to the video section in accordance with the identification information to thereby enable the video section to display lyric words of the karaoke performance in synchronization with the music tones. Preferably, the formatting includes formatting picture data contained in the karaoke data into packets for delivery to the karaoke apparatus so that the picture data can be distributed to the video section to display a background picture of the karaoke performance in superposed relation to the lyric words.

BRIEF DESCRIPTION OF THE DRAWINGS

These and other objects of the invention will be seen by reference to the description, taken in connection with the accompanying drawings, in which.

DETAILED DESCRIPTION OF PREFERRED EMBODIMENTS

This invention will be described in further detail by way of example with reference to the accompanying drawings.

Figure 1:
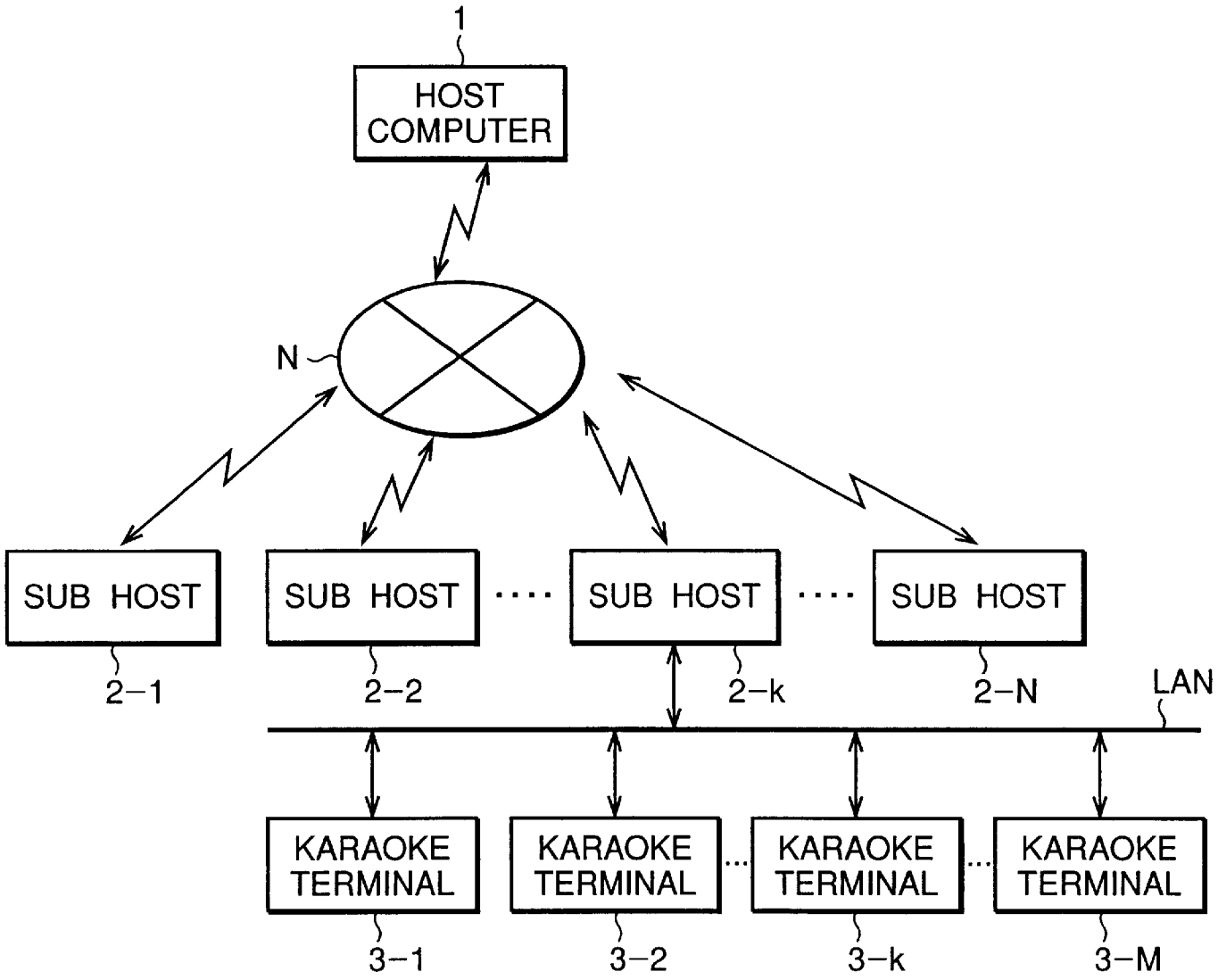
FIG. 1 is a block diagram illustrating constitution of a karaoke system practiced as a first preferred embodiment of the invention.

Now, referring to FIG. 1, there is shown a block diagram illustrating a karaoke system practiced as a first preferred embodiment of the invention. In the figure, a host computer 1 of a center station has a database storing karaoke data on which karaoke performance is based. The karaoke data includes picture data providing a background picture to be displayed during karaoke performance, and voice data providing effect voices such as back chorus. Server computers 2-1 through 2-N (hereafter referred to as sub hosts) are installed at karaoke performance facilities such as karaoke boxes. The sub host receives the karaoke data from the host computer 1 of the center station through a communication line N such as a telephone line or an ISDN (Integrated Services Digital Network). Each sub host 2-*k* has a hard disk of a large storage capacity for storing the karaoke data distributed from the host computer 1 of the center station. In each karaoke performance facility, a LAN (Local Area Network) is installed based on optical fiber cable. Through this LAN, a plurality of karaoke terminals 3-1 through 3-M are connected to one sub host 2-*k* composed of the server computer. Each karaoke terminal 3-*k* is a karaoke apparatus composed of a client computer connected to the server computer through the LAN.

In the above-mentioned constitution, the sub host 2-*k* of the karaoke performance facility delivers the karaoke data on demand to any of the karaoke terminals 3-1 through 3-M. The demanding karaoke terminal receives the karaoke data, and makes karaoke performance including music tone generation and lyric words display together with background picture display. Thus, according to this system, the karaoke performance is offered to users by on-demand basis.

Figure 2:
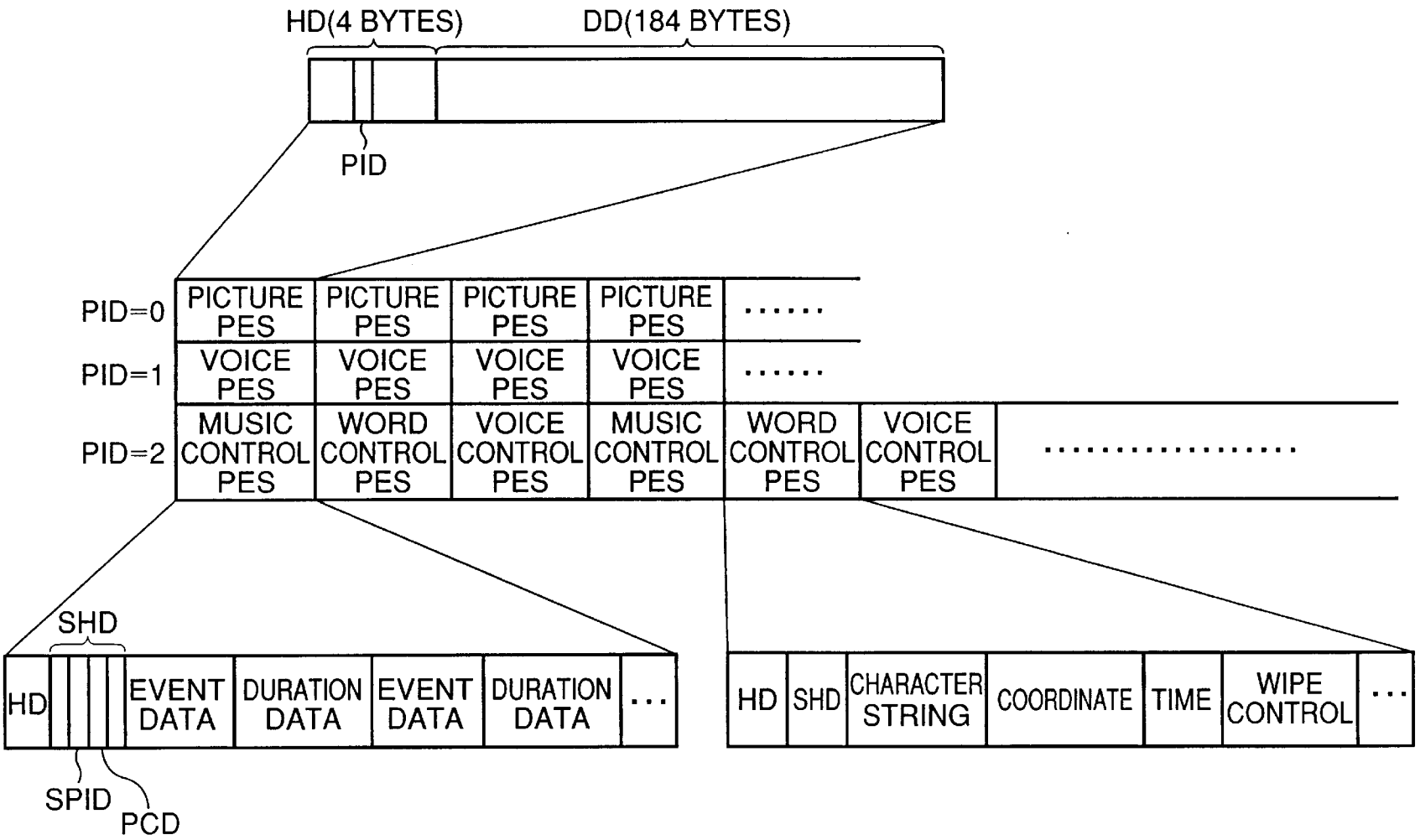
FIG. 2 is a diagram illustrating a format of karaoke data to be treated in the first preferred embodiment of FIG. 1.

The following describes a format of the karaoke data. In the present embodiment, the karaoke data is delivered in packets according to PES (Packetized Elementary Stream) of MPEG-2 (Motion Picture Experts Group 2) transport layer for example. To be more specific, as shown in FIG. 2, the karaoke data to be delivered is formatted into packets. Each packet has a total length of 188 bytes, four bytes for a header HD and 184 bytes for a body or data part DD. The header HD includes a 1-byte identifier PID. This identifier PID is actually identification information that indicates a data kind of each packet. The data kind herein denotes one of the song data for providing basic karaoke performance, the picture data for providing karaoke background picture, and the voice data for providing an effect voice such as background vocal or back chorus. For example, PID=0 denotes picture data, PID=1 denotes voice data, and PID=2 denotes song data. The picture data is packetized by compressibly coding a karaoke background picture according to MPEG-2. The voice data is packetized by recording an effect voice by ADPCM (Adaptive Differential Pulse Code Modulation).

Further, as shown in FIG. 2, the song data includes music control data for controlling generation of music tones of a karaoke song to provide an instrumental accompaniment for live singing voice, word control data for displaying the lyric words of the song in synchronization with the karaoke accompaniment, and effect voice control data for controlling reproduction of an effect voice such as background vocal. The song data is constituted by a sequence of a music control data packet, a word control data packet, and an effect voice control data packet in the order of processing at the karaoke terminal. In addition to the above-mentioned header HD, each packet has a sub header SHD of fixed length at the beginning of the 184-byte data part DD. This sub header SHD includes an identifier SPID indicating a song number and a type code PCD which is actually identification information indicative of a kind of the song data, i.e., music control data, word control data or effect voice control data. The sub header SHD further includes a sequential number used for detecting drop of a packet, relative time information measured from the beginning of a song for controlling time-sequential processing of the packets by the karaoke terminal, an internal pointer for use when the length of data is variable, a continuation marker indicative of a link between packets if data of the same kind spans two or more packets, and an end-of-data marker indicating that the packet attached with this marker is the last packet in the sequence. It should be noted that, if the length of data of one kind is short, one packet may be constituted by data of two or more kinds. In this case, the sub header SHD is attached to the beginning of data of each kind.

The music control data is written according to MIDI Musical Instrument Digital Interface) standard for example. As shown in FIG. 2, the music control data is constituted by a sequence of event data indicative of note events such as sounding and muting of music tones and duration data indicative of time intervals between successive events. The MIDI event data of note-on event is constituted by music tone control information including a channel number of a MIDI channel corresponding to a performance part of the karaoke song, a note-on indicative of sounding instruction, a note name indicative of tone pitch, and a velocity indicative of tone volume. It should be noted that a timing at which each of the above-mentioned note events is generated involves subtle errors due to various causes. Controlling this timing only by the above-mentioned duration data may accumulate these errors. To circumvent this problem, this timing is adjusted for every packet based on the above-mentioned relative time information included in the sub header SHD.

The word control data is composed of one line of characters to be displayed on a screen of a monitor, coordinate information indicative of a position at which the character string is displayed on the screen, time information indicative of a time from display of the character string to erasure thereof, and control information for wiping the character string by color wiping, as shown in FIG. 2.

The effect voice control data is constituted by data for instructing generation of an effect voice such as background vocal during the karaoke performance. The voice data for use in generating the effect voice is separately delivered as packets of the above-mentioned voice data. Namely, in the present embodiment, the voice data obtained by ADPCM-recording of various effect voices is delivered beforehand as effect voice packets. When the sequential number of a packet containing a effect voice to be reproduced is specified by the timing of the effect voice control data, the specified packet is processed for generating the specified effect voice.

The above-mentioned karaoke data packets are delivered in the order of processing at the karaoke terminal. To be more specific, the song data packets and the picture data packets are delivered alternately such that the karaoke performance and the background picture will not get out of synchronization. However, the voice data is delivered beforehand upon powering on of the karaoke terminal, because the voice data is referenced by the song data later after the karake performance starts.

As described above, the inventive method is designed for feeding karaoke data representative of karaoke performance to a karaoke terminal or karaoke apparatus having an audio section and a video section. The inventive method is conducted by the following steps. The initial step is formatting the karaoke data containing various kinds of data items including music control data and word control data into a plurality of packets such that each packet is formed of a body containing a segment of the karaoke data and a header containing identification information indicating the kind of the karaoke data contained in the body of each packet. The next step is delivering the plurality of the packets in a stream to the karaoke apparatus according to a predetermined order by which the karaoke apparatus time-sequentially processes the stream of the packets. The further step is selectively distributing the music control data contained in the processed packets to the audio section in accordance with the identification information to thereby enable the audio section to generate music tones of the karaoke performance. The last step is selectively distributing the word control data contained in the processed packets to the video section in accordance with the identification information to thereby enable the video section to display lyric words of the karaoke performance in synchronization with the music tones.

Preferably, the step of formatting includes formatting picture data contained in the karaoke data into packets for delivery to the karaoke apparatus so that the picture data is distributed to the video section to display a background picture of the karaoke performance in superposed relation to the lyric words. Preferably, the step of formatting includes formatting voice data contained in the karaoke data into packets for delivery to the karaoke apparatus so that the voice data is distributed to the audio section to reproduce a back chorus of the karaoke performance in support of the music tones. Preferably, the step of formatting comprises formatting the karaoke data into the packets such that the header of each packet contains time information indicating when the segment of the karaoke data contained in the body of each packet should be processed. Preferably, the step of formatting comprises formatting the music control data which is comprised of event data indicating events of generating the music tones and duration data indicating a duration between successive events indicated by the event data.

Figure 3:
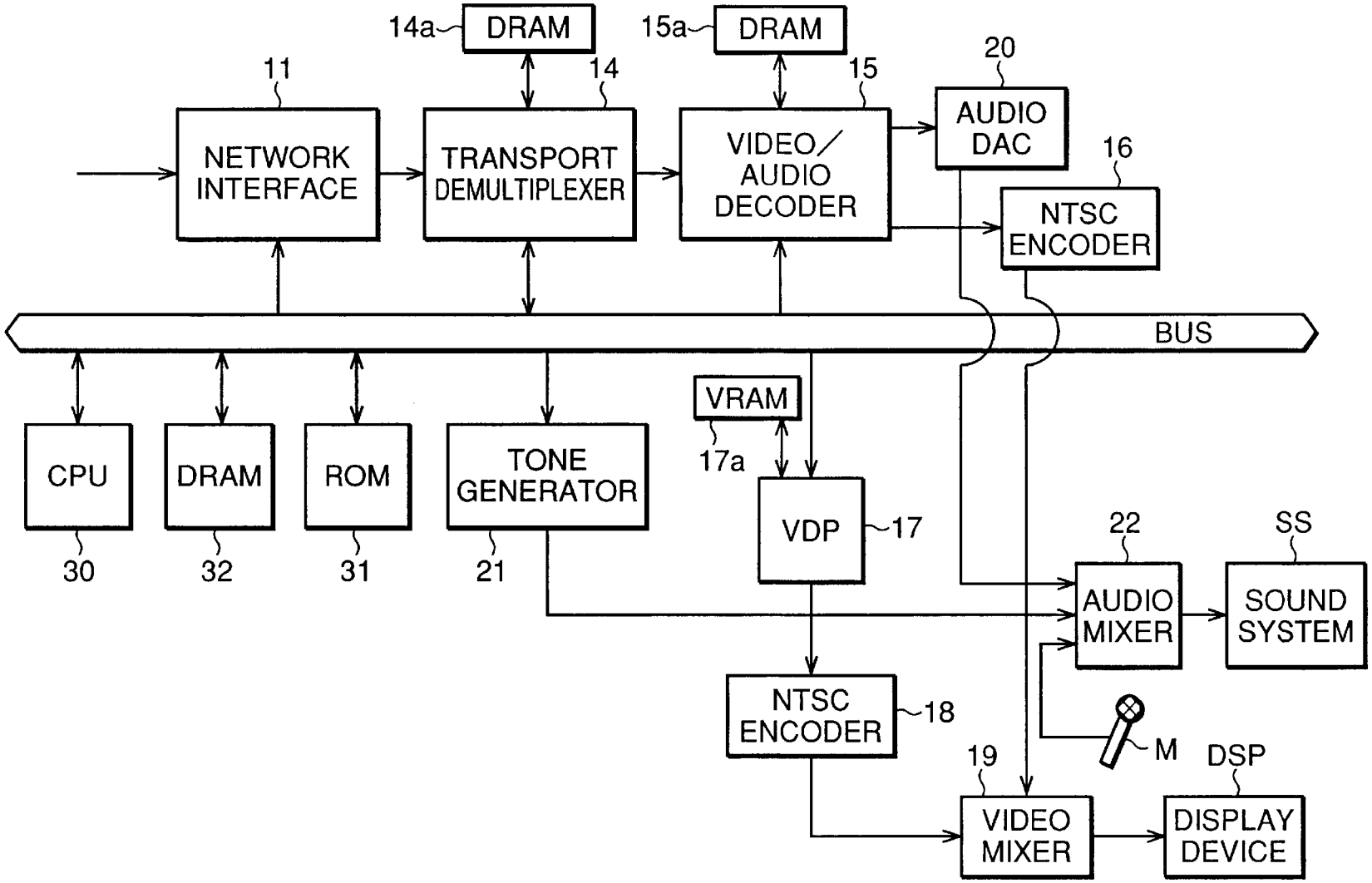
FIG. 3 is a block diagram illustrating constitution of a karaoke terminal associated with the first preferred embodiment of FIG. 1.

Referring to FIG. 3, there is shown constitution of the karaoke terminal 3-*k* practiced as the first preferred embodiment of the invention. In the figure, a network interface 11 controls communication with the sub host 2-*k* through the LAN. To be more specific, the network interface 11 sends a request signal generated when the user selects a song by means of an operator panel to the sub host 2-*k*. Also, the network interface 11 receives karaoke data packets transmitted from the sub host 2-*k* to the karaoke terminal 3-*k*. A transport demultiplexer 14 separates the karaoke data packets captured by the network interface 11 into song data, picture data, and voice data based on the identifier PID of the packets. A DRAM (Dynamic Random Access Memory) 14*a* is used as a work area for the demultiplexer 14.

A video/audio decoder 15 decodes picture data compressibly coded according to MPEG-2 to output a resultant digital video signal, and decodes ADPCM voice data to output a resultant digital audio signal. An NTSC encoder 16 converts the digital video signal supplied from the video/audio decoder 15 into an NTSC signal. A VDP (Video Display Processor) 17 expands a font image corresponding to the lyric words into VRAM (Video Random Access Memory) 17*a* based on the word control data for controlling display of the lyric words contained in the song data, and sequentially outputs the resultant image signal. Another NTSC encoder 18 converts the font image signal supplied from the VDP 17 into another NTSC signal. A video mixer 19 synthesizes the NTSC signal indicative of the lyric words supplied from the NTSC encoder 18 and the other NTSC signal indicative of background picture supplied from the NTSC encoder 16. When a resultant synthesized signal is supplied to a display device DSP, the lyric words of the song are superimposed on the karaoke background picture.

An audio DAC (Digital-to-Analog Converter) 20 converts the digital audio signal supplied from the video/audio decoder 15 into an analog audio signal. A tone generator 21 generates a music tone signal of the karaoke performance based on the music control data of the MIDI event included in the song data. An audio mixer 22 mixes the music tone signal supplied from the tone generator 21, the voice signal indicative of the live singing voice supplied from a microphone M, and the audio signal of the effect voice such as the back chorus supplied from the audio DAC 20. A resultant mixed signal is sent to a sound system SS to be sounded from a loudspeaker.

A CPU (Central Processing Unit) 30 controls the above-mentioned components interconnected through a bus. A ROM (Read Only Memory) 31 stores a control program to be executed by the CPU 30. A DRAM 32 is used as a work area for the CPU 30.

The following describes operation of the above-mentioned first embodiment having the above-mentioned constitution. First, when the karaoke terminal 3-*k* is powered on, the CPU 30 reads the control program from the ROM 31, and loads the control program into the DRAM 32. The CPU 30 executes the control program to carry out the following control operation. First, the karaoke terminal 3-*k* sends a request signal for requesting voice data to the sub host 2-*k*. Receiving the request signal, the sub host 2-*k* searches the hard disk for the requested voice data, and sends the obtained voice data to the requesting karaoke terminal 3-*k* in the form of packets. The karaoke terminal 3-*k* receives the packets through the network interface 11. The transport demultiplexer 14 operates based on the identifier PID (PID=1) to recognize that the received packets are the kind of the voice data. The voice data is therefore sent to the DRAM 32 over the bus and loaded in the DRAM 32. Subsequently, the voice data stays in the DRAM 32 during the course of the karaoke performance.

When the user selects a karaoke song on the karaoke terminal 3-*k* composed of a client computer, a request signal including a song number is sent to the sub host 2-*k* composed of a server computer. Receiving the request signal, the sub host 2-*k* searches the hard disk for the karaoke data containing song data and picture data corresponding to the song number, and sends the obtained karaoke data to the requesting karaoke terminal 3-*k* in a stream of packets shown in FIG. 2.

The karaoke terminal 3-*k* receives each packet of the karaoke data through the network interface 11. Based on the identifier PID, the transport demultiplexer 14 separates the received packets into the song data and the picture data. The picture data is sent to the video/audio decoder 15 to be decoded. The decoded data is sent to the video mixer 19 through the NTSC encoder 16. The song data is sent to the DRAM 32 over the bus and loaded into the DRAM 32 temporarily. Based on the kind code PCD, it is determined whether the song dada is music control data, word control data, or effect voice control data. According to the determined kind, corresponding processing is executed.

To be more specific, if the song data is the kind of music control data, MIDI event data contained in the music control data is sent to the tone generator 21 in synchronization with the passing of time indicated by the duration data contained in the music tone control data. From this MIDI event data, the tone generator 21 generates a karaoke music tone signal. The generated karaoke music tone signal is sent to the audio mixer 22.

If the song data is the kind of word control data, words display control information contained in this packet is sent to the VDP 17, in which a font image is generated. This font image is sent to the video mixer 19 through the NTSC encoder 18.

If the song data is the kind of effect voice control data, the voice data of the corresponding packets is read from the DRAM 32 based on the packet number of the voice data specified by the effect voice control data. The voice data read from the DRAM 32 is transferred to the video/audio decoder 15 over the bus. The video/audio decoder 15 decodes the voice data. The decoded data is sent to the audio mixer 22 through the DAC 20. It should be noted that the delivery of the voice data has already been completed before the effect voice control data is entered.

Thus, the karaoke music tone signal, the microphone input singing voice signal and the effect voice signal are mixed with each other in the audio mixer 22. The mixed signal is then sent to the sound system SS to be sounded from the loudspeaker. On the other hand, the font image is superimposed on the background picture in the video mixer 19 to be displayed on the display device DSP.

As described, according to the first preferred embodiment, the karaoke data is supplied in the form of a stream of packets which are time-sequentially processed on the karaoke terminal, so that the karaoke performance can be started without waiting for all karaoke data to be received, thereby realizing so-called on-demand karaoke performance. In addition, the above-mentioned constitution requires only a small memory capacity of the DRAM 32 for buffering the received karaoke data.

Namely, in the inventive karaoke apparatus operable according to karaoke data to provide karaoke performance, receiver means is provided in the form of the network interface 11 for receiving a plurality of packets delivered in a stream according to a predetermined order by which the packets should be processed time-sequentially. Each packet is formed of a body containing a segment of the karaoke data and a header containing identification information indicating a kind of the karaoke data contained in the body of each packet. The karaoke data contains various kinds of data items including music control data and word control data. Distributor means is provided in the form of the transport demultiplexer 14 for time-sequentially processing the received packets to distribute the music control data and the word control data contained in the processed packets separately from one another according to the identification information contained also in the processed packets. Audio means including the tone generator 21 operates in response to the music control data selectively distributed thereto for generating music tones of the karaoke performance. Video means including the VDP 17 operates in response to the word control data selectively distributed thereto for displaying lyric words of the karaoke performance on the DSP in synchronization with the music tones.

Preferably, the receiver means receives packets containing picture data as a part of the karaoke data, and the distributor means distributes the picture data contained in the received packets to the video/audio decoder 15 included in the video means so as to display a background picture of the karaoke performance in superposed relation to the lyric words on the DSP. Preferably, the distributor means distributes the music control data which is comprised of event data indicating events of generating the music tones and duration data indicating a duration between successive events indicated by the event data, and the audio means comprises a sound source or the tone generator 21 for generating the music tones in response to the event data and a controller in the form of the CPU 30 for sequentially feeding the event data to the tone generator 21 according to the duration data.

The following describes a karaoke terminal practiced as a second preferred embodiment of the invention. The above-mentioned first preferred embodiment adopts a so-called on-demand system in which karaoke data is selected on demand by a karaoke terminal. In contrast, the second preferred embodiment is constituted as a pseudo on-demand system in which many songs of karaoke data are broadcast by digital satellite broadcasting in a predetermined period, and a karaoke terminal selects desired one of the broadcast songs.

Figure 4:
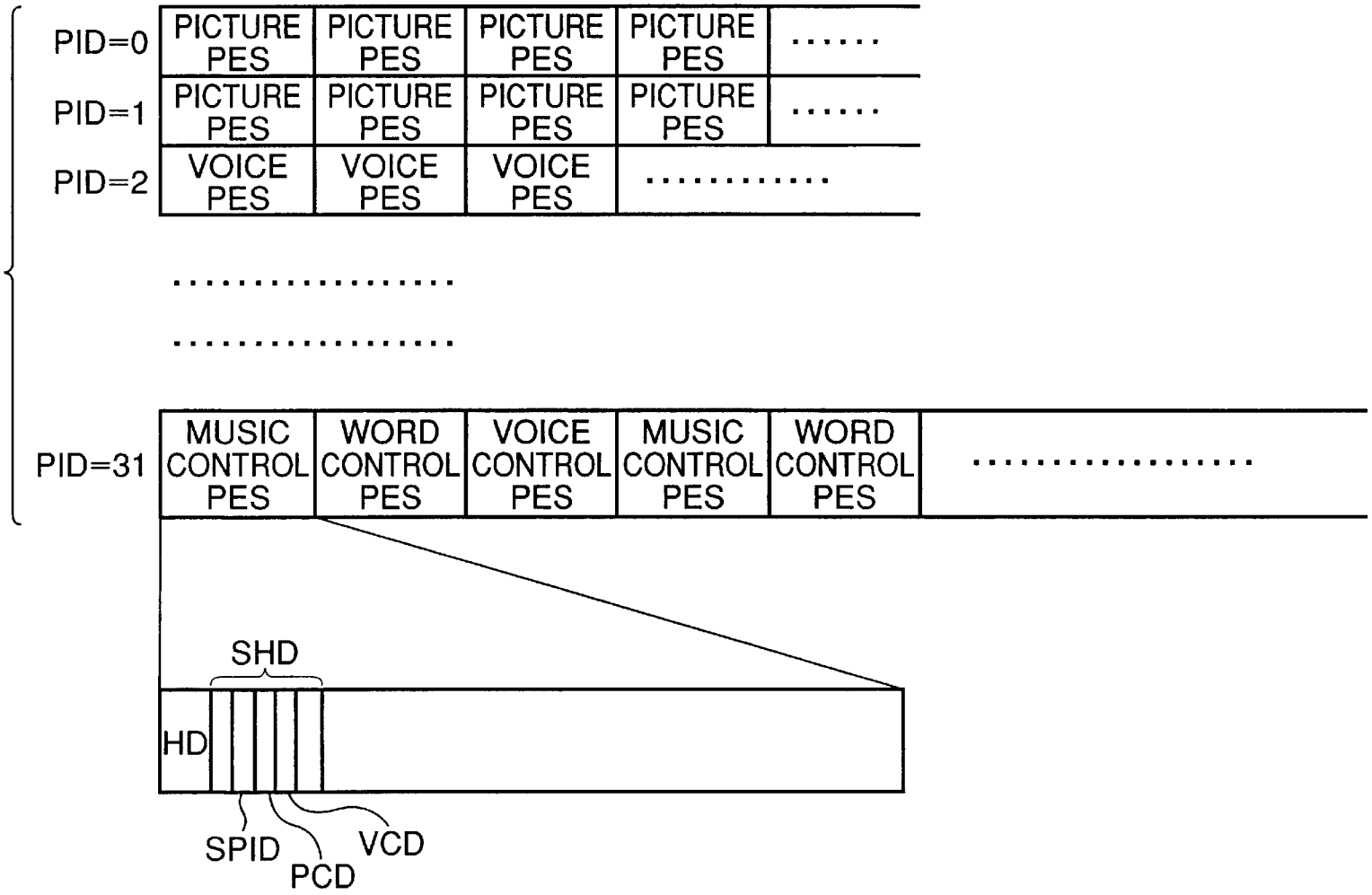
FIG. 4 is a diagram illustrating a format of karaoke data for use in a karaoke terminal practiced as a second preferred embodiment of the invention.

Referring to FIG. 4, there is shown a format of karaoke data distributed by digital satellite broadcasting. In the figure, wireless signals of one frequency band to be distributed through one transponder (a repeating amplifier installed on a communication satellite CS) are logically divided into 32 channels for example. As with the first preferred embodiment, the karaoke data assigned to each channel is formatted into packets according to the PES structure of MPEG-2 transport layer. In this case, identifiers PID contained in the header represent channel numbers 0 to 31. Picture data for providing karaoke background picture is assigned to a pair of channels with PID=0 and PID=1. ADPCM voice data for providing an effect voice such as background vocal is assigned to a channel with PID=2. Song data for providing basic karaoke performance is assigned to a channel with PID=31. As with the first preferred embodiment, the song data is constituted by a sequence of a music control data packet, a word control data packet, and a effect voice control data packet arranged in the order of processing at the karaoke terminal. Each of these packets has a sub header. However, unlike the first preferred embodiment, the sub header of the song data includes a video select code VCD for selecting one of the channels with PID=0 and PID=1 as a background picture.

It is assumed here that the frequency band used of one transponder on a communication satellite is 27 MHz, and that a data transfer capacity can be obtained by ordinary PSK (Phase Shift Keying) modulation in the order of 29 Mbps. In this condition, if one picture data channel requires a data transfer capacity of 6 Mbps and two units of this picture data channel are provided, then a capacity that can be assigned to the karaoke song data is 29 Mbps−6 Mbps×2=17 Mbps. It should be noted that a data transfer capacity required for the voice data is ignored for the sake of simplicity. On the other hand, one piece of karaoke music requires a data transfer capacity of about 100 KB/3 minutes=0.0044 Mbps, so that the number of songs that can be transmitted at a time is about 17 Mbps/0.0044 MHz=3,800. Therefore, if these 3,800 pieces of music are repeatedly transmitted in a period of three minutes for example equivalent to the performance duration of one piece of music, any one of these karaoke songs can be performed with a delay time of about 1.5 minutes in average.

Figure 5:
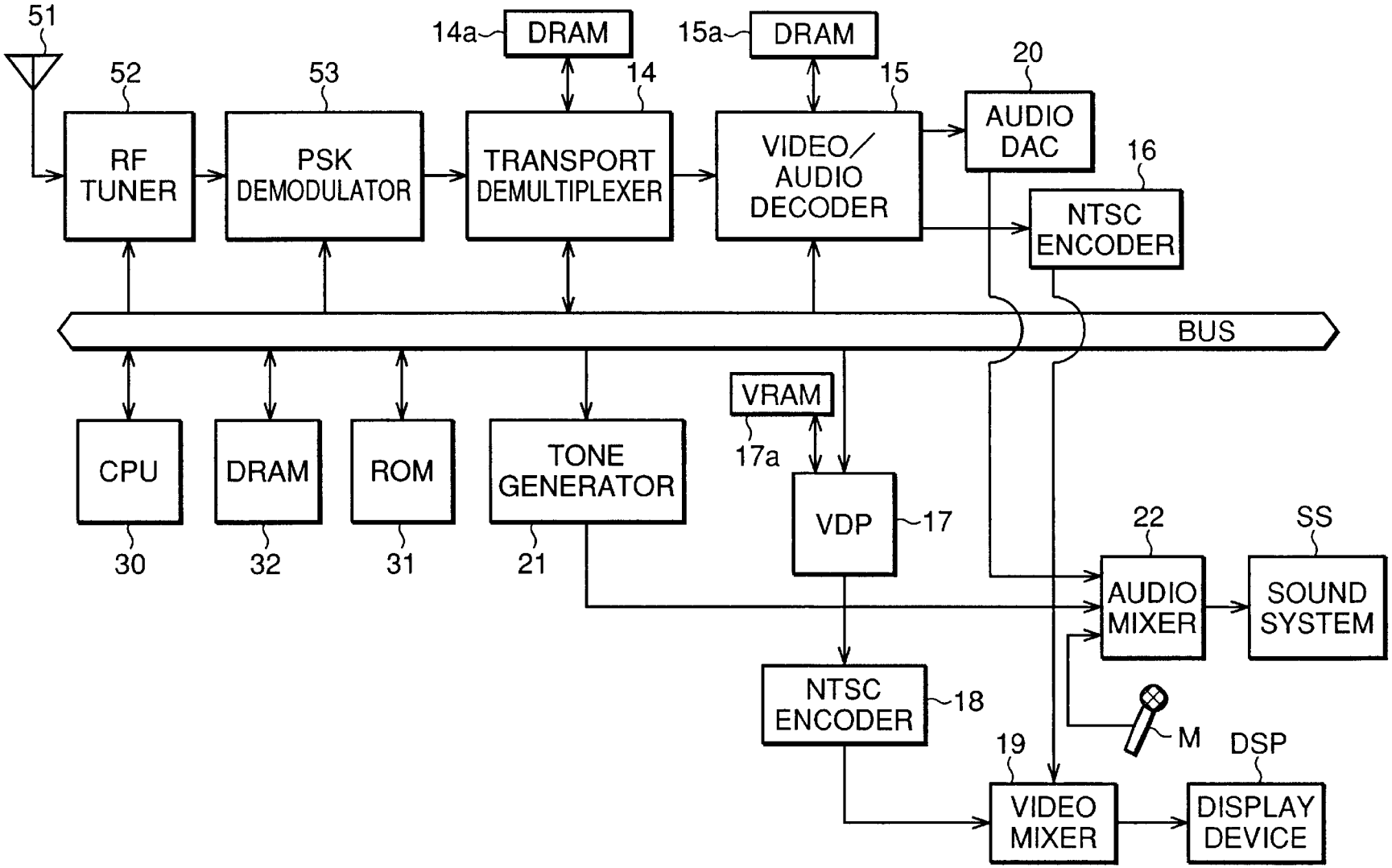
FIG. 5 is a block diagram illustrating the second preferred embodiment of FIG. 4.

Referring to FIG. 5, there is shown a block diagram illustrating constitution of the karaoke terminal practiced as the second preferred embodiment. The second preferred embodiment shown in FIG. 5 differs from the first preferred embodiment shown in FIG. 3 in that an antenna 51 for receiving broadcast carrier waves, an RF (Radio Frequency) tuner 52 for tuning a received frequency of the carrier wave, and a PSK demodulator 53 for demodulating a received PSK modulated wave are used instead of the network interface 11. The remaining portions of the constitution are the same as those shown in FIG. 3, so that the components similar to those previously described with reference to FIG. 3 are denoted by the same reference numerals, and are omitted from the following description.

In the above-mentioned constitution, when the user selects a song, the CPU 30 poicks up a start packet having an identifier SPID corresponding to the song number of the selected song from the channel (PID=31). If this start packet is found, the CPU 30 sequentially captures the packets having this identifier SPID. The CPU 30 also references the video select code VCD included in the sub header of the start packet, and receives the picture data of the corresponding channel concurrently with the reception of the above-mentioned song data. In this case, the picture data and the song data are received in a time division manner such that either of the song data and the picture does not much advance before or lag behind the other. It should be noted that the voice data is received in advance of the song data immediately after the karaoke terminal is powered on, and the received voice data is stored in the DRAM 32 beforehand. Subsequently, the received karaoke data of the various kinds are processed in the same manner as that of the first preferred embodiment for the karaoke performance.

As described, according to the second preferred embodiment, the karaoke data is supplied according to a predetermined sequence by which the received karaoke data is to be processed at the karaoke terminal as with the first preferred embodiment. This allows the karaoke performance to start without waiting for all the karaoke data to be received, thereby shortening an average wait time until start of the karaoke performance in a pseudo on-demand system based on digital satellite broadcasting. Further, as with the first preferred embodiment, the memory capacity or the storage capacity of the DRAM 32 for buffering the received karaoke data can be minimized. Still further, use of satellite broadcasting can execute a nation-wide game such as answering the title of a song by listening only its introduction part, by way of example.

The following describes a karaoke terminal practiced as a third preferred embodiment of the invention. Unlike the first and second preferred embodiments, the third preferred embodiment is not a so-called communication karaoke apparatus. The third preferred embodiment stores karaoke data of huge karaoke songs in a memory medium beforehand provided in this embodiment. When the user selects a song, the corresponding karaoke data is read from the memory medium for karaoke performance.

Figure 6:
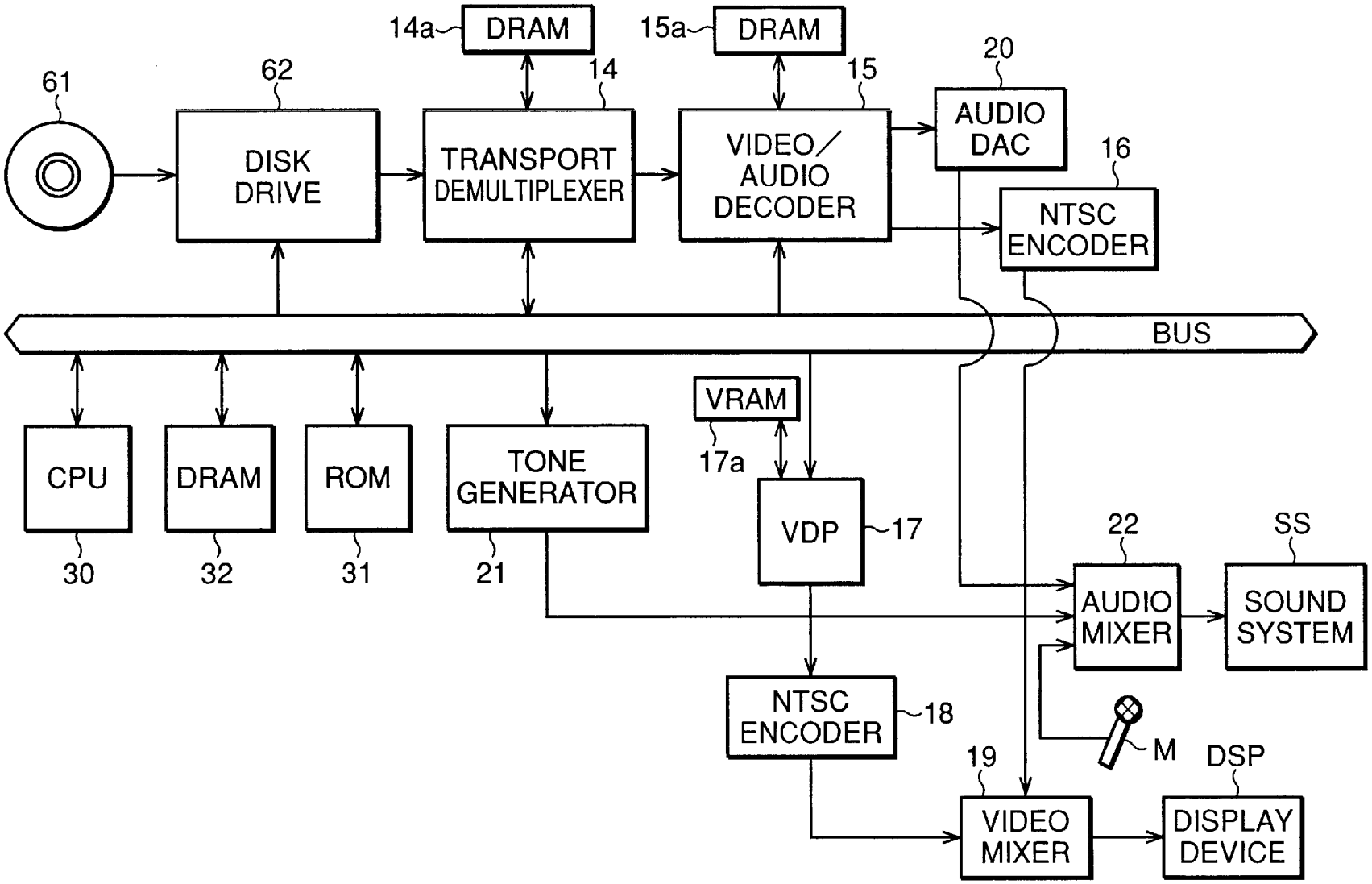
FIG. 6 is a block diagram illustrating a karaoke terminal practiced as a third preferred embodiment of the invention.

Referring to FIG. 6, there is shown a block diagram illustrating constitution of the karaoke terminal practiced as the third preferred embodiment. Third preferred embodiment shown in FIG. 6 differs from the first preferred embodiment shown in FIG. 3 in that a memory medium 61 of mass storage such as CD-ROM, DVD-ROM, or DVD-RAM and a disk drive 62 for reading karaoke data from this memory medium 61 are provided instead of the network interface 11. The remaining portions of the constitution are the same as those shown in FIG. 3, so that the components similar to those previously described with reference to FIG. 3 are denoted by the same reference numerals and are omitted from the following description.

Figure 7:
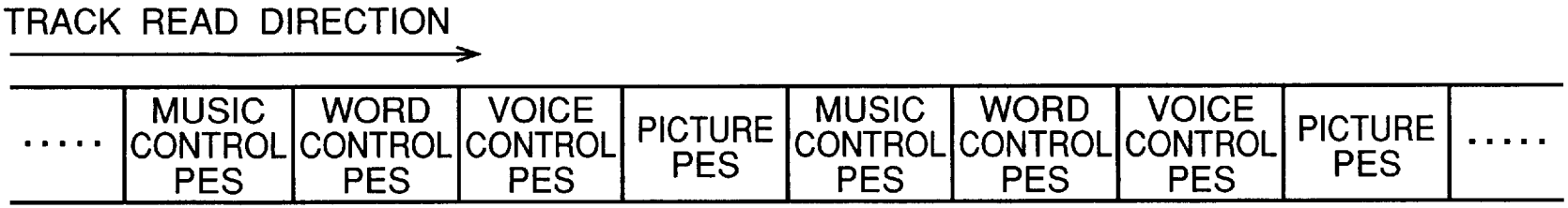
FIG. 7 is a diagram illustrating a format of karaoke data to be recorded on a memory medium associated with the third preferred embodiment of FIG. 6.

As shown in FIG. 7, the memory medium or storage medium 61 stores karaoke data packets in a sequence of music control data, word control data, effect voice control data, picture data, music control data, word control data and so on. These packets are processed at the karaoke terminal in this sequence. However, the voice data needs to be stored in the DRAM 32 before the song data is processed. Thus, the voice data is stored at the beginning of a track data area for example. When the karaoke terminal is powered on, the stored voice data is first loaded into the DRAM 32. The data structure of each of the above-mentioned packets is the same as those shown in FIG. 2.

The karaoke data is provisionally stored in the storage medium 61 in the above-mentioned embodiment. The karaoke data is read from the storage medium 61 by the disk drive 62, and is supplied to the transport demultiplexer 14 in the sequence of processing at the karaoke terminal as with the first and second preferred embodiments. Subsequently, the karaoke data is processed in the same manner as with the first and second preferred embodiments for providing karaoke performance.

As described above, the inventive memory medium or the storage medium 61 memorizes karaoke data representative of karaoke performance, and is useable for feeding the karaoke data to a karaoke apparatus having an audio section and a video section. The storage medium 61 records the karaoke data by formatting the karaoke data containing various kinds of data items including music control data and word control data into a plurality of packets such that each packet is formed of a body containing a segment of the karaoke data and a header containing identification information indicating the kind of the karaoke data contained in the body of each packet. As shown in FIG. 7, the plurality of the packets are arranged for delivery in a stream to the karaoke apparatus according to a predetermined order by which the karaoke apparatus time-sequentially processes the stream of the packets, so that the music control data contained in the processed packets can be distributed to the audio section in accordance with the identification information to thereby enable the audio section to generate music tones of the karaoke performance, and so that the word control data contained in the processed packets can be distributed to the video section in accordance with the identification information to thereby enable the video section to display lyric words of the karaoke performance in synchronization with the music tones. Preferably, the formatting includes formatting picture data contained in the karaoke data into packets for delivery to the karaoke apparatus so that the picture data can be distributed to the video section to display a background picture of the karaoke performance in superposed relation to the lyric words.

According to the third preferred embodiment, the karaoke data is supplied to the transport demultiplexer 14 in a sequence of processing at the karaoke terminal in the karaoke system of recording/reproducing type in similar manner as in the first and second embodiments of the communication type. This constitution allows karaoke performance to start without waiting for all karaoke data to be supplied, thereby shortening the wait time until start of karaoke performance. This constitution also minimizes the memory capacity or the storage capacity of the DRAM 32 for buffering the karaoke data read from the storage medium 61.

As described above, the inventive karaoke system is constructed for feeding karaoke data representative of karaoke performance from a data source to a karaoke apparatus. The data source comprises format means for formatting the karaoke data containing various kinds of data items including music control data and word control data into a plurality of packets such that each packet is formed of a body containing a segment of the karaoke data and a header containing identification information indicating the kind of the karaoke data contained in the body of each packet, and delivery means for delivering the plurality of the packets in a stream to the karaoke apparatus according to a predetermined order by which the karaoke apparatus time-sequentially processes the stream of the packets. The karaoke apparatus comprises receiver means for receiving the plurality of the packets delivered from the data source, distributor means for time-sequentially processing the received packets to distribute the music control data and the word control data contained in the processed packets separately from one another according to the identification information contained also in the processed packets, audio means operative in response to the music control data selectively distributed thereto for generating music tones of the karaoke performance, and video means operative in response to the word control data selectively distributed thereto for displaying lyric words of the karaoke performance in synchronization with the music tones.

Specifically, in the first embodiment shown in FIGS. 1 through 3, the delivery means comprises a server computer in the form of the sub host 2-*k* connected to the karaoke apparatus or the karaoke terminal 3-*k* composed of a client computer through a network. The sub host 3-*k* is responsive to a request from the karaoke apparatus to transmit the packets to the network. The receiver means comprises the network interface 11 of the client computer for receiving the packets from the network.

Specifically, in the second embodiment shown in FIGS. 4 and 5, the delivery means comprises a broadcast station such as a communication satellite for broadcasting the packets by means of a carrier wave. The receiver means comprises the antenna 51 for receiving the carrier wave and the tuner 52 for separating the packets from the carrier wave.

Specifically, in the third embodiment shown in FIGS. 6 and 7, the delivery means comprises a memory disk or the storage medium 61 storing the karaoke data formatted into the plurality of the packets. The receiver means comprises the disk drive 62 for receiving the memory disk to retrieve therefrom the packets of the karaoke data.

The present invention is not restricted to the above-mentioned embodiments, and therefore allows the following variations for example to be made.

(1) In each of the above-mentioned preferred embodiments, the PES structure of MPEG-2 transport layer is used for the packet format. It will be apparent that other structures may be selected according to the standard to be used. Essentially, the packets of karaoke data may only be supplied to a karaoke apparatus in the sequence by which these packets are processed at the karaoke apparatus.

(2) As for the first or second preferred embodiment, the channel constitution at karaoke data delivery is not restricted to the format shown in FIG. 2 or FIG. 4. It will be apparent that, according to various conditions such as the standard to be used and the data transfer capacity, the number of picture data channels for example may be increased or decreased appropriately. In each of the first through third preferred embodiments, only picture data may be reproduced from an internal storage medium provided on the karaoke terminal. Further, the voice data such as background vocal may be omitted according to various conditions including the data transfer capacity.

(3) In the third preferred embodiment, the storage medium 61 for recording karaoke data may be any other kind than the optical disk mentioned above for example. The storage medium 61 may be any other optical disk or a magnetic recording medium such as a hard disk as long as the medium allows mass storage and high-speed access. If such a storage medium is used, the disk drive 62 is modified accordingly.

As described and according to the invention, the wait time from requesting a karaoke song to starting karaoke performance can be significantly shortened. The memory capacity for buffering karaoke data to be supplied or reproduced can be made significantly smaller than that used in the prior art technologies.

While the preferred embodiments of the present invention have been described using specific terms, such description is for illustrative purposes only, and it is to be understood that changes and variations may be made without departing from the spirit or scope of the appended claims.

What is claimed is:

1. A method of feeding karaoke data representative of karaoke performance to a karaoke apparatus having an audio section and a video section, the method comprising the steps of:

formatting the karaoke data containing various kinds of data items including music control data and word control data into a plurality of packets such that each packet is formed of a body containing a segment of the karaoke data and a header containing identification information indicating the kind of the karaoke data contained in the body of each packet;

delivering the plurality of the packets in a stream to the karaoke apparatus according to a predetermined order by which the karaoke apparatus time-sequentially processes the stream of the packets;

selectively distributing the music control data contained in the processed packets to the audio section in accordance with the identification information to thereby enable the audio section to generate music tones of the karaoke performance; and selectively distributing the word control data contained in the processed packets to the video section in accordance with the identification information to thereby enable the video section to display lyric words of the karaoke performance in synchronization with the music tones.

2. The method according to claim 1, wherein the step of formatting includes formatting picture data contained in the karaoke data into packets for delivery to the karaoke apparatus so that the picture data is distributed to the video section to display a background picture of the karaoke performance in superposed relation to the lyric words.

3. The method according to claim 1, wherein the step of formatting includes formatting voice data contained in the karaoke data into packets for delivery to the karaoke apparatus so that the voice data is distributed to the audio section to reproduce a back chorus of the karaoke performance in support of the music tones.

4. The method according to claim 1, wherein the step of formatting comprises formatting the karaoke data into the packets such that the header of each packet contains time information indicating when the segment of the karaoke data contained in the body of each packet should be processed.

5. The method according to claim 1, wherein the step of formatting comprises formatting the music control data which is comprised of event data indicating events of generating the music tones and duration data indicating a duration between successive events indicated by the event data.

6. The method according to claim 1, wherein the step of formatting includes formatting picture data contained in the karaoke data into packets for delivery to the karaoke apparatus so that the picture data is distributed to the video section to display a background picture of the karaoke performance in superposed relation to the lyric words.

7. A karaoke apparatus operable according to karaoke data to provide karaoke performance, comprising:

receiver means for receiving a plurality of packets delivered in a stream according to a predetermined order by which the packets should be processed time-sequentially, each packet being formed of a body containing a segment of the karaoke data and a header containing identification information indicating a kind of the karaoke data contained in the body of each packet, the karaoke data containing various kinds of data items including music control data and word control data;

distributor means for time-sequentially processing the received packets to distribute the music control data and the word control data contained in the processed packets separately from one another according to the identification information contained also in the processed packets;

audio means operative in response to the music control data selectively distributed thereto for generating music tones of the karaoke performance; and video means operative in response to the word control data selectively distributed thereto for displaying lyric words of the karaoke performance in synchronization with the music tones.

8. The karaoke apparatus according to claim 7, wherein the receiver means receives packets containing picture data as a part of the karaoke data, and wherein the distributor means distributes the picture data contained in the received packets to the video means so as to display a background picture of the karaoke performance in superposed relation to the lyric words.

9. The karaoke apparatus according to claim 7, wherein the distributor means distributes the music control data which is comprised of event data indicating events of generating the music tones and duration data indicating a duration between successive events indicated by the event data, and wherein the audio means comprises a sound source for generating the music tones in response to the event data and a controller for sequentially feeding the event data to the sound source according to the duration data.

10. A system of feeding karaoke data representative of karaoke performance from a data source to a karaoke apparatus, wherein the data source comprises format means for formatting the karaoke data containing various kinds of data items including music control data and word control data into a plurality of packets such that each packet is formed of a body containing a segment of the karaoke data and a header containing identification information indicating the kind of the karaoke data contained in the body of each packet, and delivery means for delivering the plurality of the packets in a stream to the karaoke apparatus according to a predetermined order by which the karaoke apparatus time-sequentially processes the stream of the packets, and wherein the karaoke apparatus comprises receiver means for receiving the plurality of the packets delivered from the data source, distributor means for time-sequentially processing the received packets to distribute the music control data and the word control data contained in the processed packets separately from one another according to the identification information contained also in the processed packets, audio means operative in response to the music control data selectively distributed thereto for generating music tones of the karaoke performance, and video means operative in response to the word control data selectively distributed thereto for displaying lyric words of the karaoke performance in synchronization with the music tones.

11. The system according to claim 10, wherein the format means includes means for formatting picture data contained in the karaoke data into packets for delivery to the karaoke apparatus so that the picture data is distributed to the video means to display a background picture of the karaoke performance in superposed relation to the lyric words.

12. The system according to claim 10, wherein the delivery means comprises a server computer connected to the karaoke apparatus composed of a client computer through a network, the server computer being responsive to a request from the karaoke apparatus to transmit the packets to the network, and wherein the receiver means comprises a network interface of the client computer for receiving the packets from the network.

13. The system according to claim 10, wherein the delivery means comprises a broadcast station for broadcasting the packets by means of a carrier wave, and wherein the receiver means comprises an antenna for receiving the carrier wave and a tuner for separating the packets from the carrier wave.

14. The system according to claim 10, wherein the delivery means comprises a memory disk storing the karaoke data formatted into the plurality of the packets, and wherein the receiver means comprises a disk drive for receiving the memory disk to retrieve therefrom the packets of the karaoke data.

15. A method of recording karaoke data representative of karaoke performance to a memory medium useable for supplying the karaoke data to a karaoke apparatus having an audio section and a video section, the method comprising the steps of:

formatting the karaoke data containing various kinds of data items including music control data and word control data into a plurality of packets such that each packet is formed of a body containing a segment of the karaoke data and a header containing identification information indicating the kind of the karaoke data contained in the body of each packet;

arranging the plurality of the packets for delivery in a stream to the karaoke apparatus according to a predetermined order by which the karaoke apparatus time-sequentially processes the stream of the packets so that the music control data contained in the processed packets can be distributed to the audio section in accordance with the identification information to thereby enable the audio section to generate music tones of the karaoke performance, and so that the word control data contained in the processed packets can be distributed to the video section in accordance with the identification information to thereby enable the video section to display lyric words of the karaoke performance in synchronization with the music tones; and storing the plurality of packets into the memory medium.

* * * * *